US007270566B1

(12) United States Patent
Liao

(10) Patent No.: US 7,270,566 B1
(45) Date of Patent: Sep. 18, 2007

(54) FLEXIBLE CIRCUIT BOARD CONNECTOR

(75) Inventor: Huang-Heng Liao, Hukou Township, Hsinchu County (TW)

(73) Assignee: Singatron Enterprise Co., Ltd., Hsinchu County (TW)

( * ) Notice: Subject to any disclaimer, the term of this patent is extended or adjusted under 35 U.S.C. 154(b) by 0 days.

(21) Appl. No.: 11/432,614

(22) Filed: May 12, 2006

(51) Int. Cl.
*H01R 12/24* (2006.01)

(52) U.S. Cl. ..... 439/495

(58) Field of Classification Search ..... 439/495, 439/260, 267
See application file for complete search history.

(56) References Cited

U.S. PATENT DOCUMENTS 6,533,606 B2 * 3/2003 Yamane ..... 439/495
6,755,682 B2 * 6/2004 Kunishi et al. ..... 439/495
6,767,233 B2 * 7/2004 Tsunematsu ..... 439/260
7,063,559 B2 * 6/2006 Wang et al. ..... 439/495

* cited by examiner

*Primary Examiner*—Alexander Gilman
(74) *Attorney, Agent, or Firm*—Troxell Law Office, PLLC

(57) ABSTRACT

A flexible circuit board connector is at least composed of a base, a loose cover, a plurality of terminals, and a plurality of insertion terminals. The base is provided with symmetric grooves which are used to provide for an emplacement of projected shafts of the loose cover, so as to prevent the loose cover from being displaced horizontally. Next, front ends of the plural terminals are pressed into through-holes of loose cover, so as to prevent the loose cover from being dropped off in a vertical direction. Then, through an insertion of the plural insertion terminals, positions of the projected shafts of loose cover are lifted up by abutted parts at front ends of the insertion terminals, so as to position the loose cover. In addition, the abutted part is also provided with an inverted hook, such that the insertion terminal can be tightly emplaced in the hole.

8 Claims, 6 Drawing Sheets

FLEXIBLE CIRCUIT BOARD CONNECTOR

BACKGROUND OF THE INVENTION (a) Field of the Invention

The present invention relates to a flexible circuit board connector, and more particularly to a connector which can be assembled conveniently.

(b) Description of the Prior Art

An ordinary conventional connector is assembled by first inserting a plurality of terminals into a base, followed by assembling a loose cover into the base, which enables front ends of the plural terminals to be transfixed into slots on the loose cover. At this time, a fixing piece should be inserted into the base, so as to prevent the loose cover from being dropped off, which will cause an inconvenience in assembling.

Accordingly, how to get rid of the aforementioned problems is a technical issue to be solved by the present inventor.

SUMMARY OF THE INVENTION

The primary object of present invention is to provide an improved structure of a flexible circuit board connector and the advantages of the invention are as follows:

1. It is convenient to assemble.
2. The terminals and the loose cover are not easy to be dropped off.
3. The FPC (Flexible Printed Circuit Board) can be more tightly connected.
4. It is provided with advancement and practicability.
5. It can improve an industrial competitiveness.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
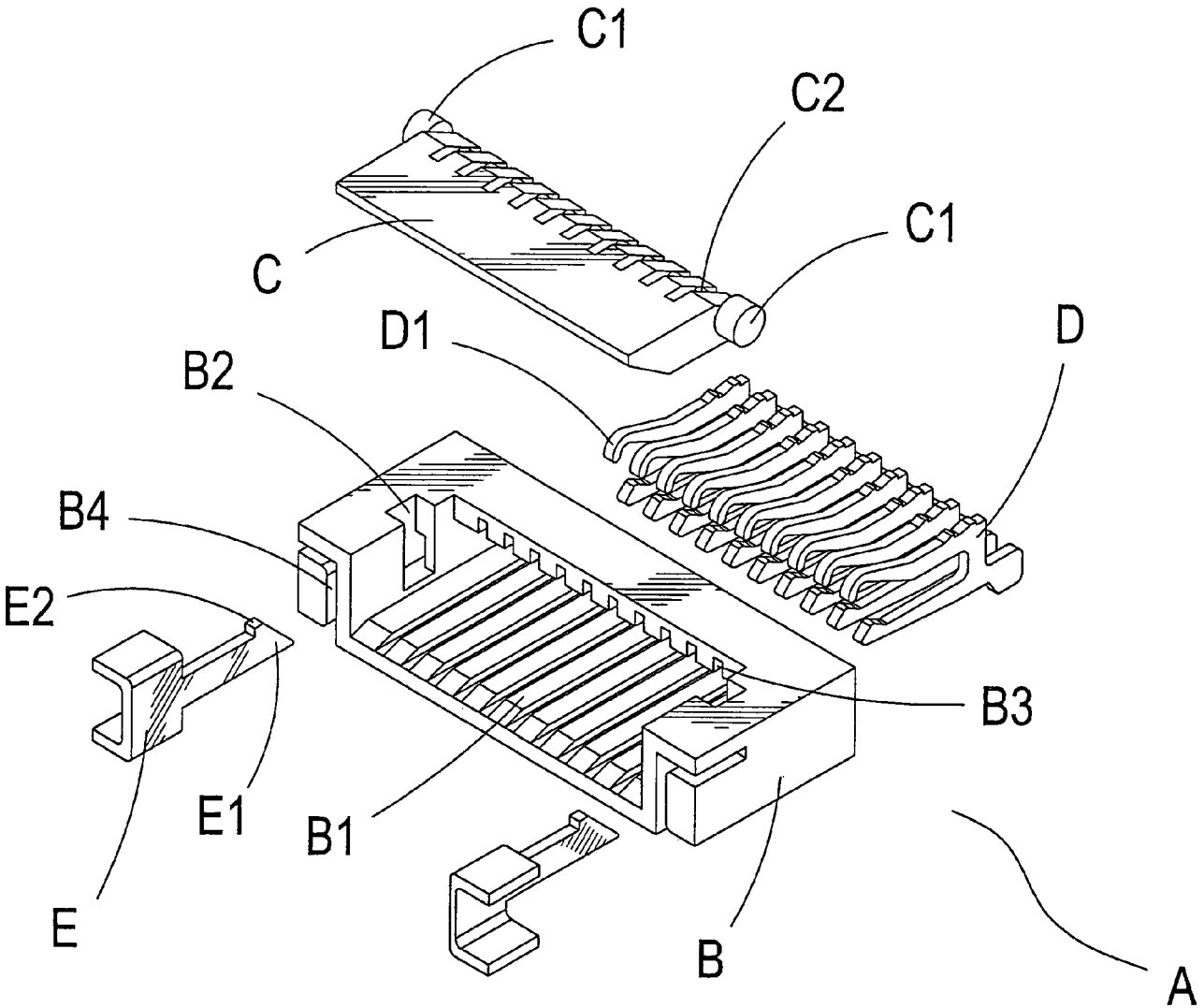
FIG. 1 shows an exploded view of the present invention.

Referring to FIG. 1, a connector A is at least composed of a base B, a loose cover C, a plurality of terminals D, and a plurality of insertion terminals E, wherein the base B is provided with a connection slot B1, two symmetric sides of which are provided with grooves B2 respectively, and above which is fitted with the loose cover C having projected shafts C1 emplaced in the grooves B2, respectively.

Figure 2:
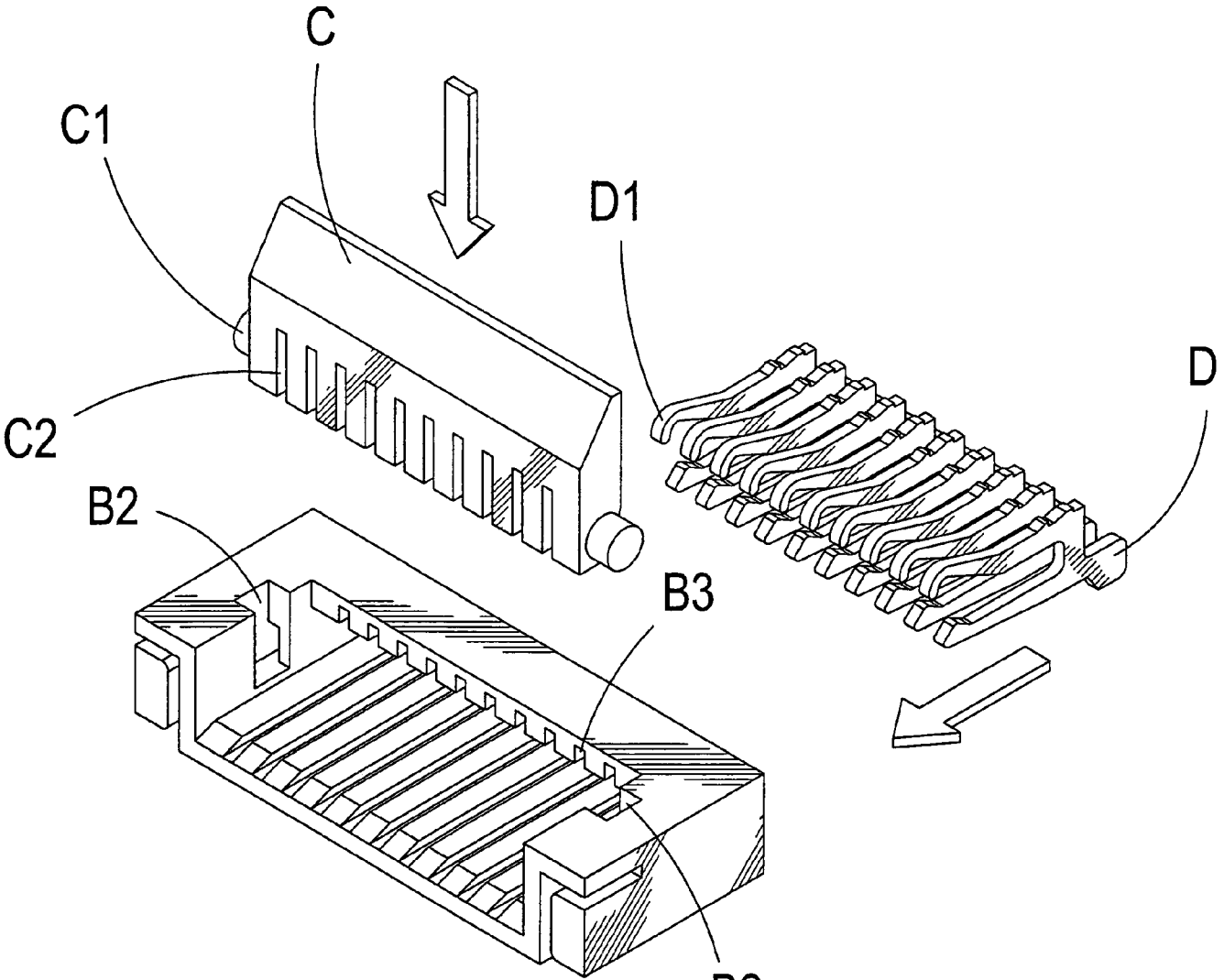
FIG. 2 shows a schematic view of an embodiment of the present invention.
Figure 3:
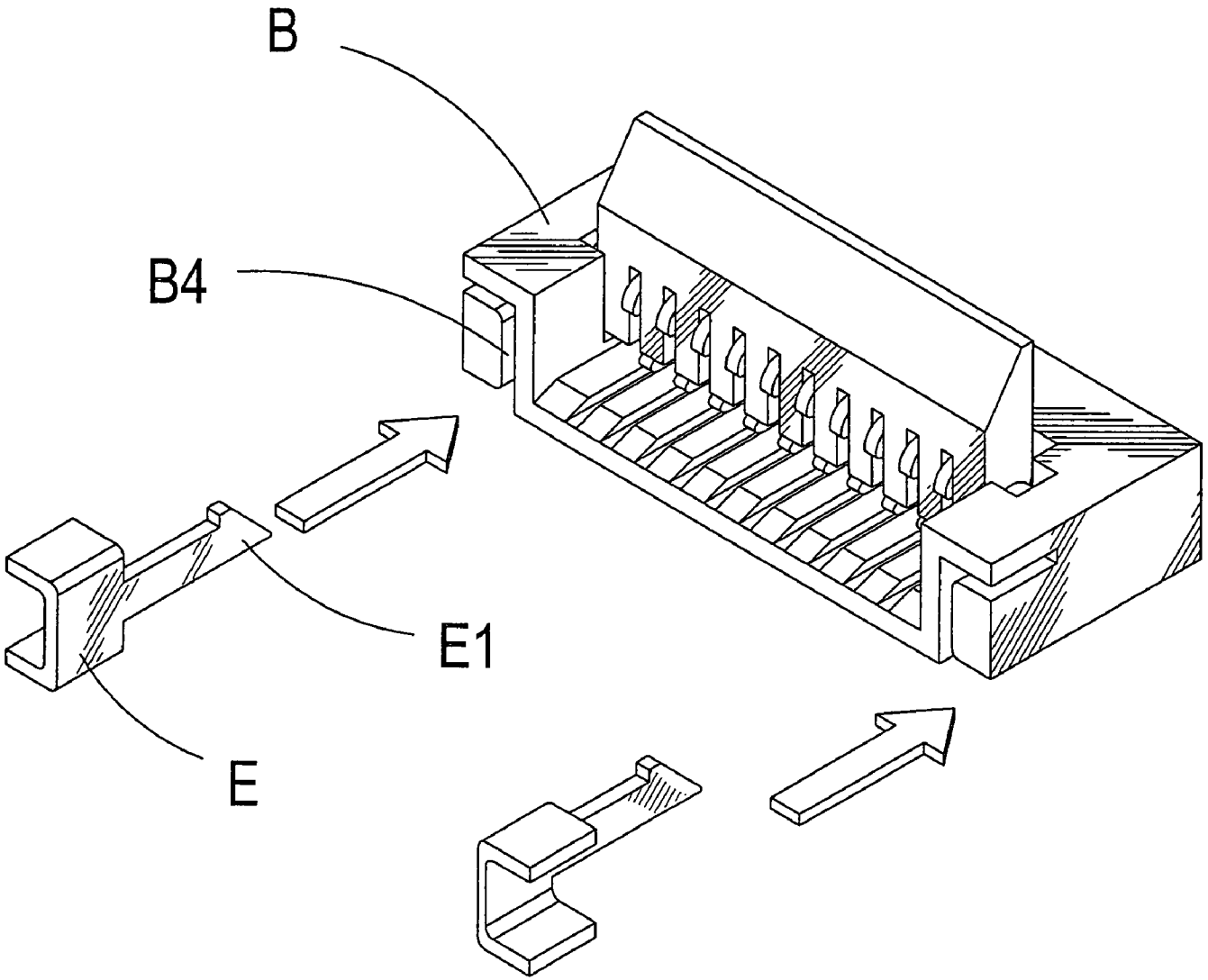
FIG. 3 shows a second schematic view of an embodiment of the present invention.
Figure 4:
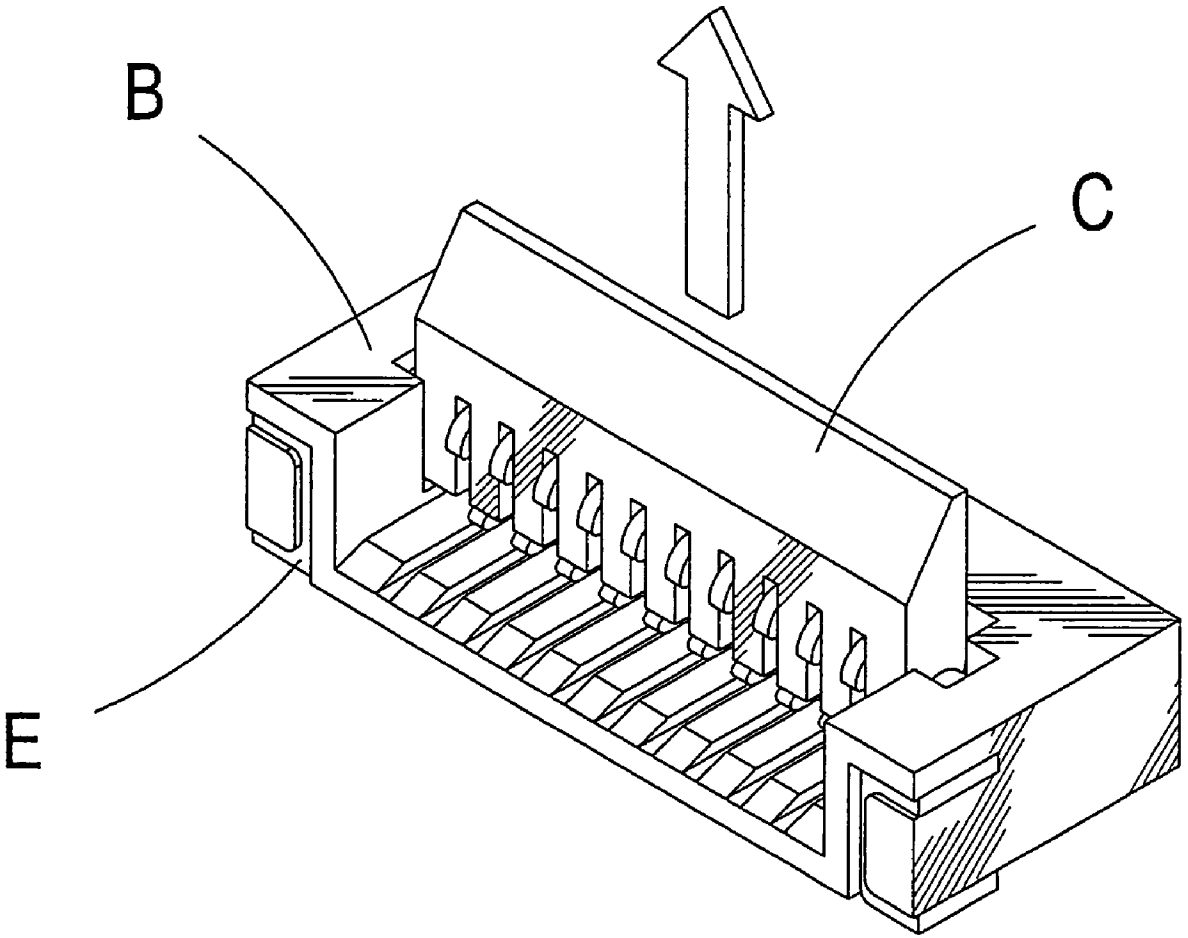
FIG. 4 shows a third schematic view of an embodiment of the present invention.

A side of the base B is installed with a plurality of through-holes B3 which are correspondingly transfixed with the plurality of terminals D, and front ends of the terminals D are all correspondingly transfixed into a plurality of through-holes C2 installed on the loose cover C. In addition, the other side of base B is installed with two symmetric holes B4 which are inserted with an insertion terminal E respectively. The insertion terminals E are tightly emplaced in the holes B4 by inverted hooks E2 installed on abutted parts E1 at tail ends of the insertion terminals E. Referring to FIGS. 2 to 4, when projected shafts C1 of a loose cover C are correspondingly installed in grooves B2 of a base B, the loose cover C can be pivoted on the base B. Next, plural terminals D are correspondingly inserted into plural through-holes B3 on the base B, such that front ends D1 of the terminals D can be transfixed into through-holes C2 installed on the loose cover C, so as to prevent the loose cover C from being dropped off in a vertical direction. Moreover, plural insertion terminals E are inserted into symmetric holes B4 on the base B, and front ends of the insertion terminals E are provided with abutted parts E1, such that the projected shafts C1 can be lifted up by an abutting of the abutted parts E1, thereby positioning the loose cover C.

Figure 5:
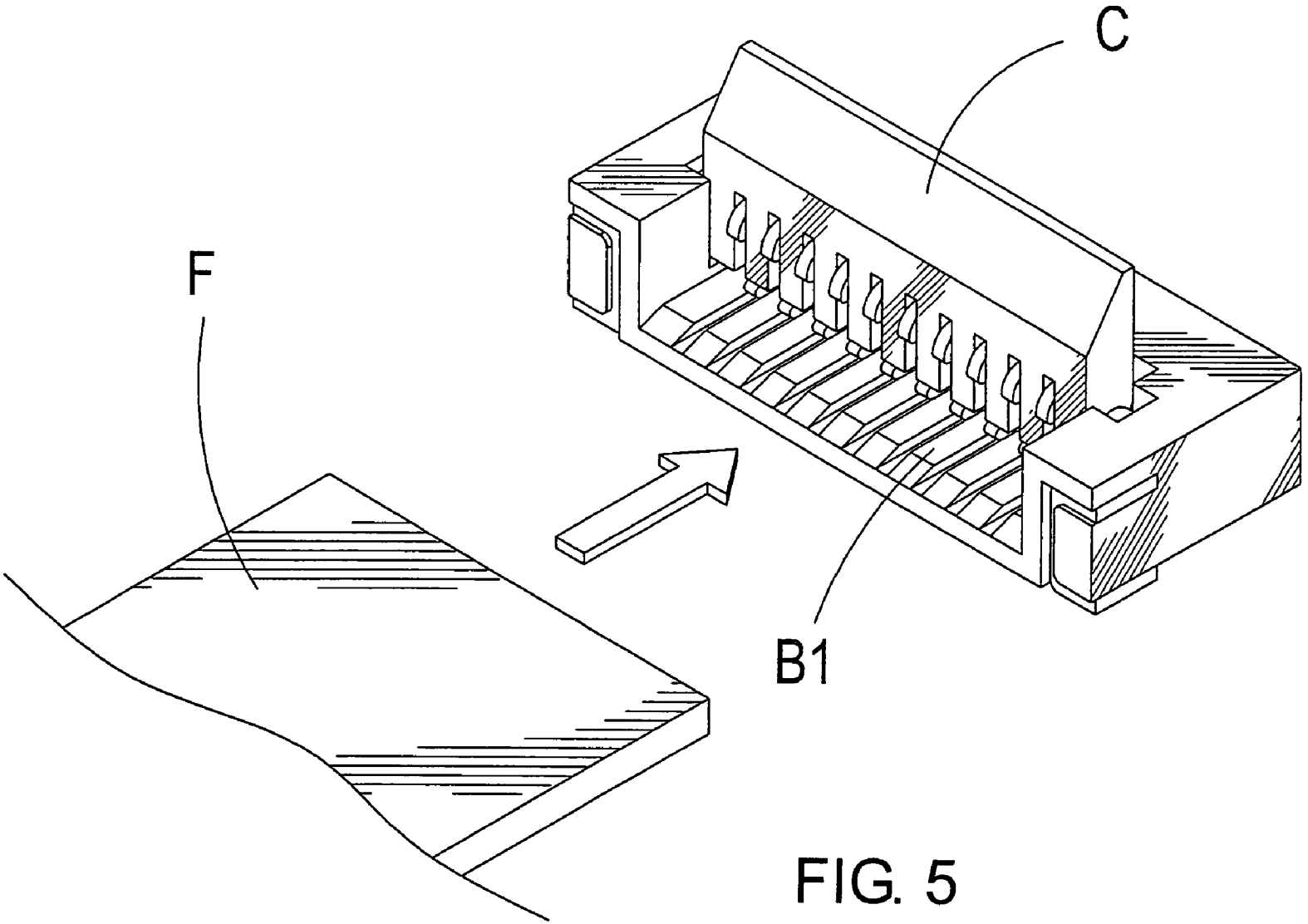
FIG. 5 shows a fourth schematic view of an embodiment of the present invention.
Figure 6:
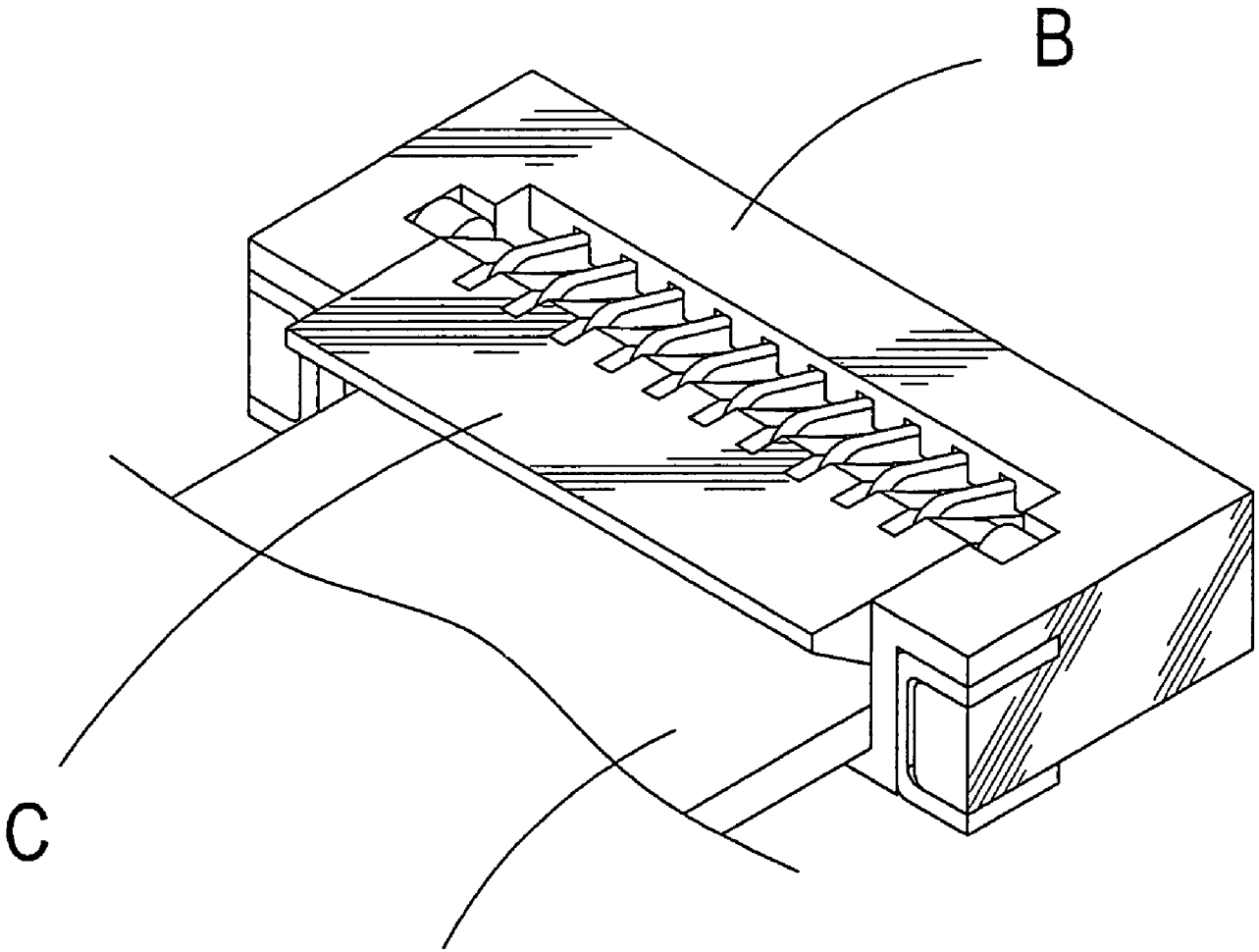
FIG. 6 shows a fifth schematic view of an embodiment of the present invention.

Referring to FIG. 5 and FIG. 6, a connection slot B1 of the base B is provided for an insertion of an FPC which can be tightly connected through a pivoting of the loose cover C.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A flexible circuit board connector for a flexible printed circuit board comprising:

a) a base having:

I) a connection slot;

ii) two symmetrical grooves, one of the two symmetrical grooves is located on each to two opposing sides of the base;

iii) a plurality of through holes located through a back of the base; and iv) two symmetrical holes, one of the two symmetrical holes is located on each to the two opposing sides at a front of the base;

b) a cover having two projected shafts located on opposing sides thereof and being pivotally connected to the base; one of the two projected shafts is inserted into each of the two symmetrical holes;

c) a plurality of terminals inserted into the plurality of through holes of the base; and d) two insertion terminals, one of the two insertion terminals is inserted into one of the two symmetrical holes, each of the two insertion terminals has a U-shaped cross section and an abutted part extending from an end thereof toward the cover, the abutted part of each of the two insertion terminals positioning the cover by engaging and lifting one of the two projected shafts of the cover.

2. The flexible circuit board connector according to claim 1, wherein the two symmetrical grooves of the base preventing the cover from being deflected horizontally.

3. The flexible circuit board connector according to claim 1, wherein each of the plurality of terminals corresponds to one of the plurality of through holes.

4. The flexible circuit board connector according to claim 1, wherein the cover is fixed by pressing the plurality of terminals into the plurality of through holes.

5. The flexible circuit board connector according to claim 1, wherein each of the two insertion terminals has an inverted hook located on the abutted part.

6. The flexible circuit board connector according to claim 1, wherein the flexible printed circuit board is inserted into the connection slot.

7. The flexible circuit board connector according to claim 1, wherein the U-shaped cross section of each of the two insertion terminals has two edges communicating with an exterior of the two opposing sides of the base.

8. The flexible circuit board connector according to claim 1, each of the two symmetrical holes communicating with the front of the base, an exterior of the base, and one of the two symmetrical grooves.

* * * * *